United States Patent [19]

Jowitt et al.

[11] Patent Number: 4,938,337

[45] Date of Patent: Jul. 3, 1990

[54] REMOVING A CAN FROM A ROTATING TURRET

[75] Inventors: Frederick W. Jowitt; Robert H. Harrison; Keith West; Kevin J. Pope, all of Oxfordshire, United Kingdom

[73] Assignee: Metal Box Public Limited Company, United Kingdom

[21] Appl. No.: 193,455

[22] PCT Filed: Jun. 26, 1987

[86] PCT No.: PCT/GB87/00454

§ 371 Date: May 6, 1988

§ 102(e) Date: May 6, 1988

[87] PCT Pub. No.: WO88/00255

PCT Pub. Date: Jan. 14, 1988

[30] Foreign Application Priority Data

Jul. 7, 1986 [GB] United Kingdom ..... 8616514

[51] Int. Cl.[5] ..... B65G 47/24

[52] U.S. Cl. ..... 198/377; 198/476.1; 198/478.1; 198/470.1; 198/803.9

[58] Field of Search ..... 198/377, 404, 474.1, 198/476.1, 477.1, 478.1, 803.7, 803.9, 470.1; 294/104, 110.2, 116

[56] References Cited

U.S. PATENT DOCUMENTS

| | | | |
|---|---|---|---|
| 3,127,210 | 3/1964 | Schreiber | 198/377 X |
| 3,175,704 | 3/1965 | McCreery | 198/404 X |
| 3,208,579 | 9/1965 | Perrier et al. | 198/377 |
| 3,308,928 | 3/1967 | Mosterd | 198/803.7 |
| 3,614,958 | 10/1971 | Perrier | 198/377 X |
| 3,710,928 | 1/1973 | van Zijp | 198/803.7 X |
| 3,995,745 | 12/1976 | Chambers | 198/377 X |
| 4,149,623 | 4/1979 | Nelson | 198/803.7 X |
| 4,172,514 | 10/1979 | Shantz et al. | 198/470.1 |

FOREIGN PATENT DOCUMENTS

| | | | |
|---|---|---|---|
| 1063736 | 12/1983 | U.S.S.R. | 198/377 |
| 1466067 | 3/1977 | United Kingdom | 198/404 |

*Primary Examiner*—Robert J. Spar
*Assistant Examiner*—D. Glenn Dayoan
*Attorney, Agent, or Firm*—Diller, Ramik & Wight

[57] ABSTRACT

An outfeed transfer device has a rotatable turret from which radiate a plurality of can grippers each of which is arranged to grip a can delivered to it at an outfeed station of an electro-coating apparatus, and then to rotate the can, so as to empty fluid still remaining in it, before releasing it in the inverted draining position on to an outfeed conveyor. Each can gripper comprises a jaw assembly carried on a radial shaft which is mounted for rotation in a turret side wall. A pinion fixed on that shaft is rotated by a vertical rack which is slidably carried in transverse walls of the turret. Each jaw assembly is operated by a slidable shaft carried co-axially in the associated radial shaft. The respective racks and co-axial shafts are driven by cam followers biased against stationary cams disposed within the turret.

14 Claims, 5 Drawing Sheets

FIG. 3
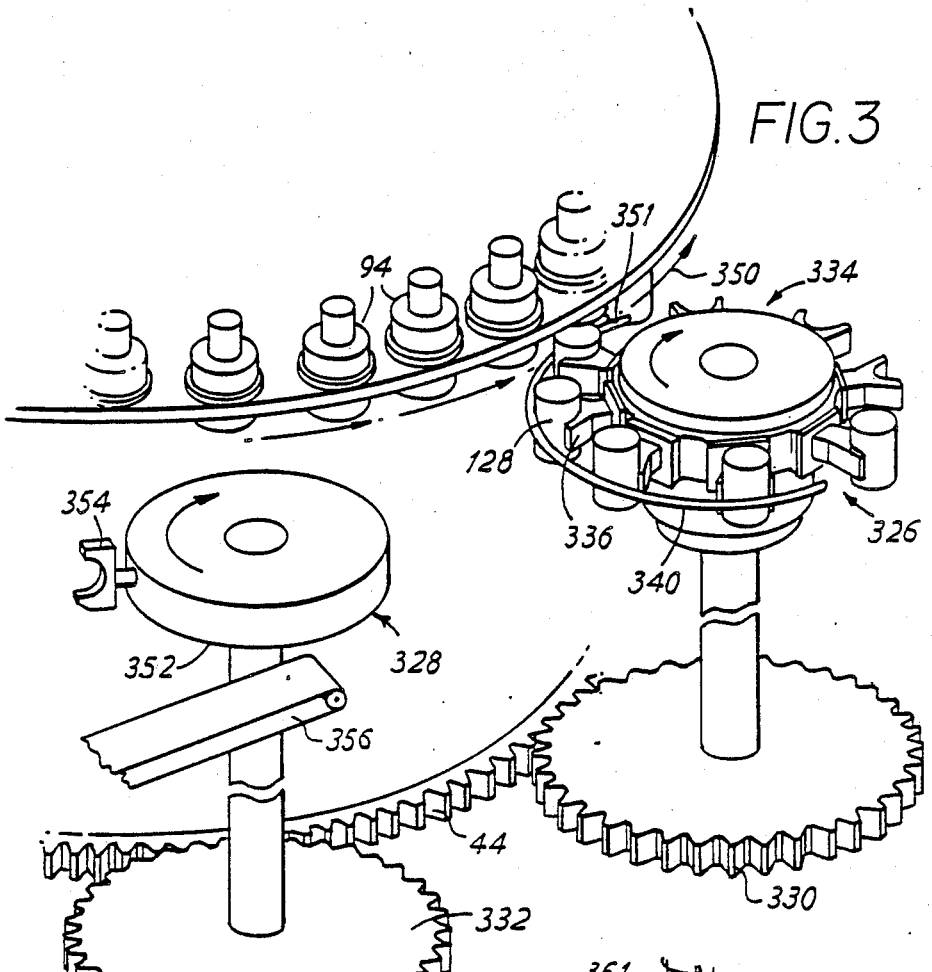
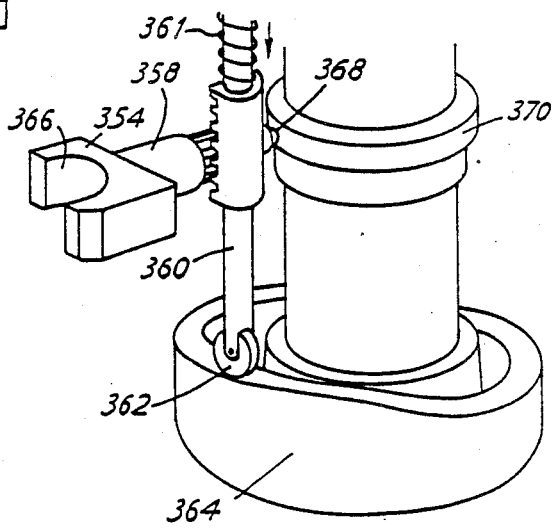
FIG. 4

REMOVING A CAN FROM A ROTATING TURRET

TECHNICAL FIELD

This invention relates to an outfeed transfer apparatus for removing cans or like containers, or other articles, from a rotating turret as they are delivered by the turret to an outfeed station, and particularly to such a transfer apparatus for use in conjunction with an electro-coating apparatus.

CROSS-REFERENCES TO RELATED APPLICATIONS

The following concurrently-filled, co-pending U.S. patent applications claim other aspects of the electro-coating apparatus referred to hereinbelow: Ser. Nos. 07/193,451; 07/193,452; and 07/193,454, now U.S. Pat. No. 4,883,578, and all filed on May 6, 1988.

BACKGROUND ART

It is known to remove a can from a rotating turret by means of a rotating star wheel which is arranged so that adjacent prongs of the star wheel embrace the can and sweep it off the turret.

It is also known in the can conveying art to convey a can on a conveyor belt beyond a wheel or pulley around which the belt turns back on itself, and to cause such a can, when toppling off the end of the conveyor belt, to strike a bar mounted adjacent the wheel in such a way that the can lands upside down on a receiving surface.

In copending Ser. No. 07/193,452 filed May 6, 1988 there is described an apparatus for electro-coating cans. In that apparatus, each electro-coated can leaves a rotating, electro-coating turntable with a quantity of spent electrolyte contained therein, which electrolyte has to be emptied from the can into an electrolyte recovery channel before the can can proceed to a next production stage in which the electro-coating is cured and so hardened.

The present invention seeks to provide an apparatus for removing such electro-coated cans from the electro-coating turret, and for depositing them inverted on to a receiving surface, all without damaging the cans or the relative delicate, uncured electro-coating carried thereby.

One electro-coating apparatus embodying the present invention, and its method of operation, and various modifications of such apparatus and method (all according to the present invention), will now be described by way of example and with reference to the accompanying diagrammatic drawings.

DISCLOSURE OF THE INVENTION

According to the present invention, a transfer apparatus is characterised in that:

a transfer wheel comprises a hollow drum member comprising spaced upper and lower transverse walls and a peripheral side wall connecting them;

radial shafts are rotatably carried in said side wall with said gear pinions disposed within said drum member; and gear racks are disposed within said drum member, and are slidably carried in said upper and lower transverse walls.

Preferred features of the present invention include the following. Such preferred features may be combined appropriately in accordance with the description given hereafter.

Said gear racks penetrate said upper transverse wall, and a fluid-tight protective cover is provided on said upper transverse wall to prevent ingress within said drum member of fluid from outside.

Said driving shaft extends upwardly through said lower and upper transverse walls and is drivingly connected to said upper transverse wall.

Said stationary support includes a stationary sleeve through which said driving shaft extends, and said upper and lower transverse walls are rotatably carried on said sleeve.

Said stationary support includes a base wall from which said stationary sleeve extends, and said base wall has a peripheral cylindrical side wall which cooperates in a fluid-tight manner with peripheral parts of said lower transverse wall to prevent ingress of fluid from outside.

Said first cam is carried on said stationary sleeve, and said second cam is carried on said base wall.

Said stationary sleeve connects with said base wall to define an annular oil reservoir.

An oil pumping sleeve encircles said driving shaft, is drivingly connected thereto, contacts said stationary sleeve internally, and has an oil pumping spriral groove facing the adjacent surface of said stationary sleeve.

Each said radial shaft is carried in a bearing assembly which is removably secured in said side wall of said drum member, thereby to allow the withdrawal radially of the radial shaft and parts secured thereto.

Each said jaw assembly comprises a first arcuate jaw member mounted on the associated radial shaft for rotation therewith, a second arcuate jaw member pivotally mounted on said first jaw member, and said jaw actuating means includes a jaw actuating shaft coupled to said second jaw member and movable axially through said radial shaft thereby to move said second jaw member between said gripping and relaxed positions.

Each said second jaw member when in its relaxed position defines together with said first jaw member an entrance for entry of a said container between said jaw members, which entrance is inclined at a predetermined acute angle relative to the axis of rotation of said radial shaft and associated first jaw member so as to facilitate engagement of said jaw members, when in the relaxed condition, around a container approaching on said turret.

The path (locus) of a said container relative to said relaxed jaw members when moving into said entrance between them at an outfeed station of said turret is substantially the same as that of said container relative to said relaxed jaw members when leaving said entrance and being carried away from them by an associated outfeed conveyor.

Said first jaw member forms a cradle for receiving a said container, and said second jaw member is arranged for engaging said container at a position disposed remotely from said cradle and such that the container is gripped by said jaw members over a predetermined arc of its circumference, which arc exceeds one half of the container circumference by a predetermined small amount sufficient to ensure control of a gripped container.

The pivotal connection of said second jaw member on said first jaw member, and the container-engaging part of said second jaw member both lie on the same side of said first jaw member relative to the axis of rotation of said first jaw member.

Said second jaw member includes a container-ejecting portion disposed on the side of said pivotal connection remote from said container-engaging part, which portion on relaxing the jaw members moves against a container thereby to urge it away from and so assist its exit from the gripped position between said jaw members.

Other features of the present invention will appear from a reading of the description that follows hereafter and of the claims appended at the end of that description.

One outfeed transfer apparatus according to the present invention, as incorporated in an electro-coating apparatus, and its method of operation, and various modifications of such transfer apparatus (all according to the present invention), will now be described by way of example and with reference to the accompanying diagrammatic drawings.

BRIEF DESCRIPTION OF THE DRAWINGS

In those drawings:

FIG. 3 shows in a further diagrammatic form the subject matter of FIG. 2;

FIG. 4 shows in schematic form the mechanism for operating one can holding device of the outfeed device;

BEST MODES OF CARRYING OUT THE INVENTION

In the description that follows hereafter, an asterisk shown in association with a reference number indicates a first mention of that reference number.)

Figure 1:
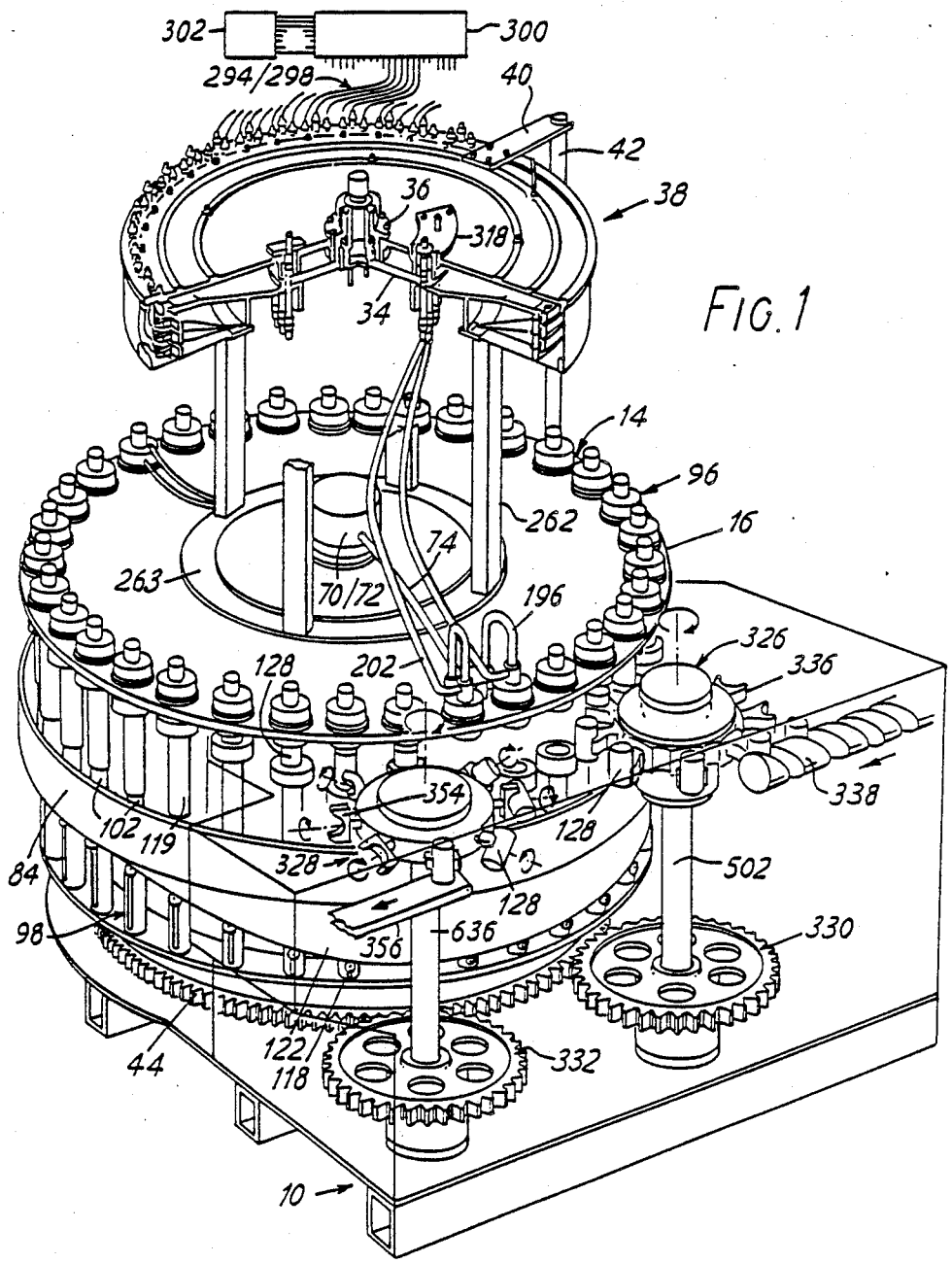
FIG. 1 shows a pictorial representation of the electro-coating apparatus and the associated outfeed device (transfer apparatus) for removing cans which have been electro-coated.
Figure 2:
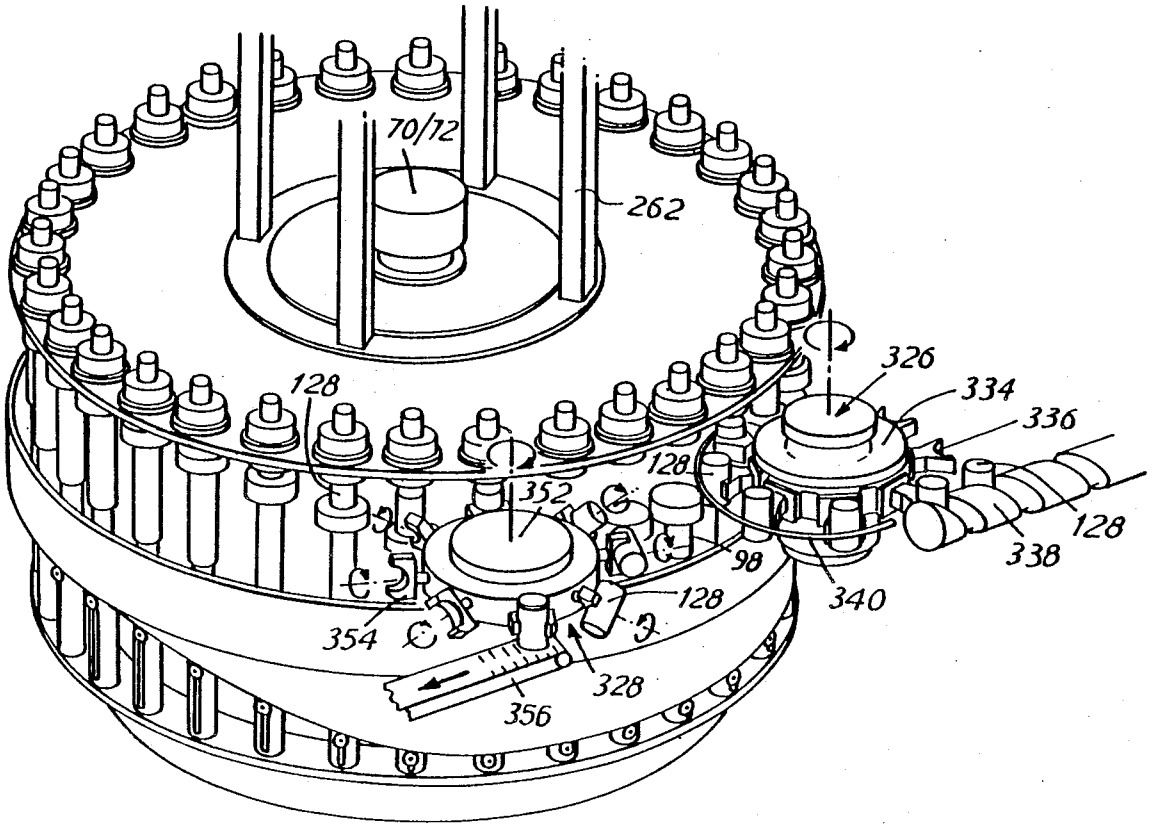
FIG. 2 shows diagrammatically an enlargement of a lower part of the FIG. 1.

Referring now to the drawings, FIG. 1 shows an electro-coating apparatus for electro-coating metal can bodies 128* (referred to hereafter simply as 'cans') of the kind having a cylindrical side wall extending integrally from a base wall. For a full description of the apparatus, the reader's attention is hereby directed to the co-pending U.S. patent applications which are listed at the end of this description.

Briefly, however, the electro-coating apparatus comprises a turntable 14* having mounted in an upper plate 16* thereof a series of spaced electro-coating cell bodies 96* into which respective upright cans 128 are to be introduced from below, and then be enclosed by, respective pneumatically operated cell closers 100*, for the performance of the electro-coating process. Each electro-coating cell body incorporates a system of concentric electrodes between which the side wall of the can is to be accurately and concentrically positioned for electro-coating. Cans 128, delivered spaced apart by a screw conveyor 338*, are transfered to the electro-coating apparatus at an infeed station by an infeed transfer device 326*.

Each can in turn is carried around a circular path by the turntable 14. During the course of that travel, the electro-coating process is completed, and the cell closer is again lowered in time for the arrival of the electro-coated can at an outfeed station. At that station, the electro-coated can is removed from the cell closer 100 by an outfeed transfer device 328*, which will now be described in detail.

Figure 5:
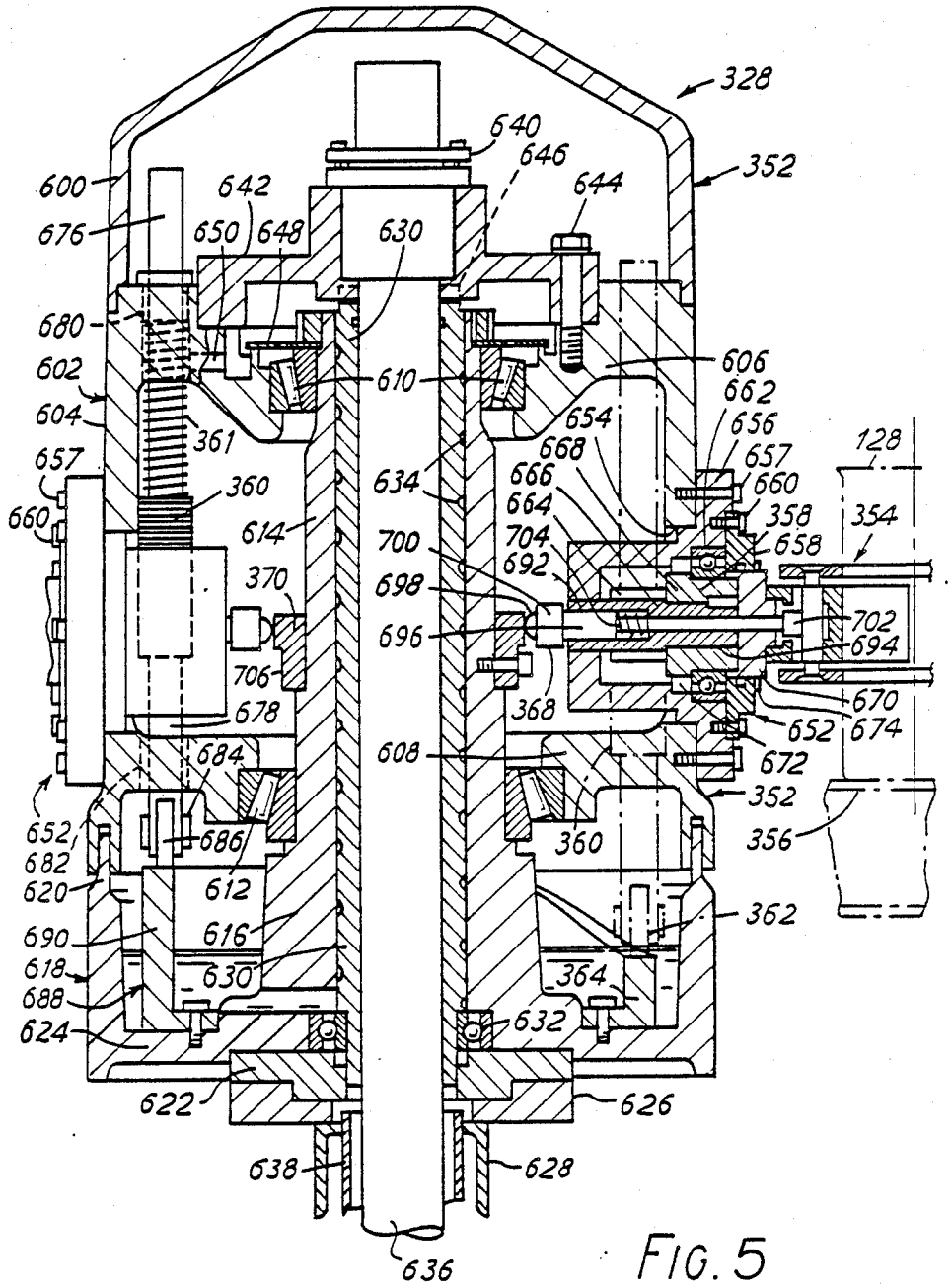
FIG. 5 shows in a vertical section the construction and mode of operation of the outfeed device, which cross section is taken on a diametral plane of the outfeed device.
Figure 9:
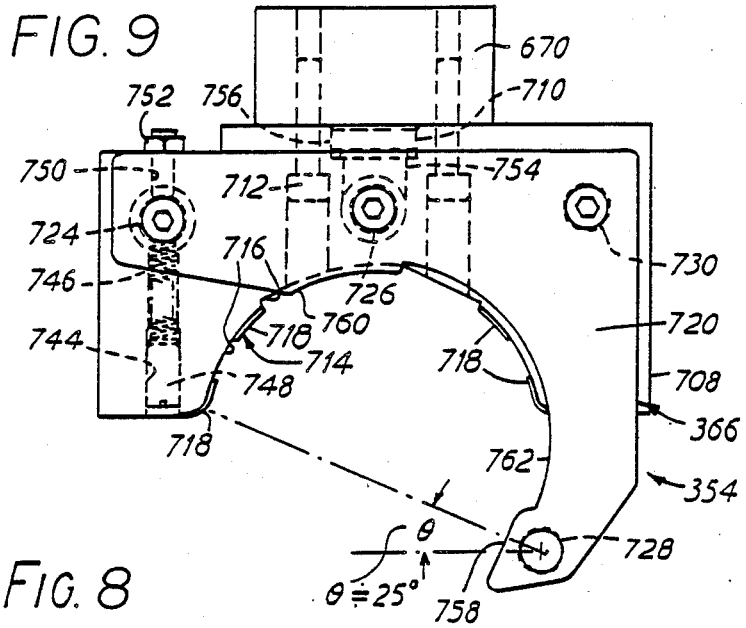
FIGS. 6 through 9 show the construction of several can gripper assemblies incorporated in the outfeed device.
Figure 8:
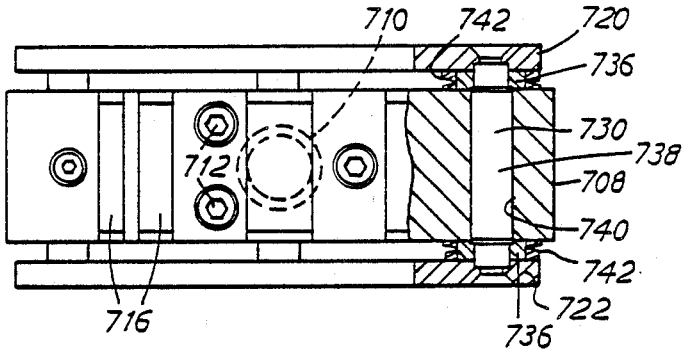
Figure 6:
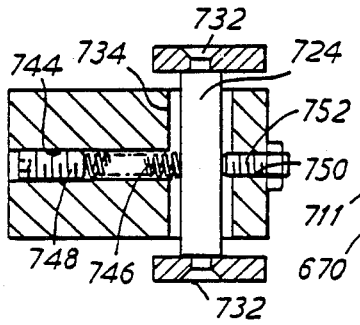
Figure 7:
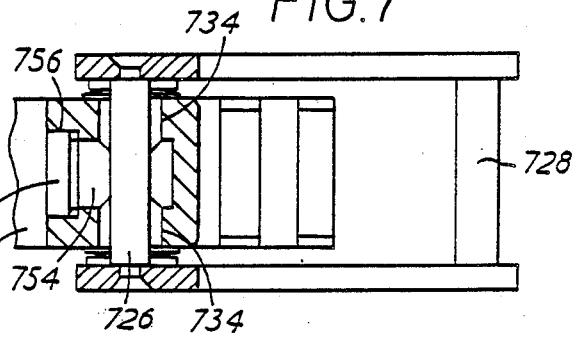

Referring now to the FIGS. 3, 4 and 5, the outfeed device 328 includes a rotatable turret 352*, which turret carries a series of eight can-grippers 354* spaced apart around it and arranged to receive in turn successive cans that are brought by rotation of the drum unit 14 to a predetermined outfeed station adjacent the outfeed device. Each of the can-grippers is arranged so as in turn, to lightly grip and remove from the cell lid 100 passing through the outfeed station a can presented to it at that station, then as the turret moves on, to rotate the can clockwise (as seen from the turret) about its transverse axis through an angle of 180° so as to empty the coating fluid still remaining in the can into a trough below (not shown) and thereafter release and deposit the can, open end downwards, on to an outfeed conveyor 356*, and finally on continued rotation of the turret, to reverse the gripper to its former position ready to receive the next can presented to it at the outfeed station.

Each can gripper 354 is carried within the turret 352 on a rotatable shaft 358* having gear teeth which engage with those of a vertically-reciprocable gear rack 360*. That rack is spring biased by a compression spring 131 to its lowermost position, and has associated with it, within the turret, a cam follower wheel 362* which cooperates with a static annular cam 364* of cyclically varying height. When the gripper is at the outfeed station ready to pick up a can, the height of the cam beneath the follower wheel is at a maximum value.

During rotation of the turret through a first half revolution from the outfeed station, the cam allows the rack to move temporarily to a lower position and then, during the second half revolution, causes the rack to return to its biased upper position. Such movement of the rack thus rotates the associated gripper shaft 358 through 180° (thereby rotating a gripped can so as to empty its contents in the direction of rotation of the turret), and then returns it to its former position, all within the course of one complete revolution of the turret, so as to achieve the desired can gripper operation.

Each can gripper 354 includes a movable jaw member 366* which is biased to a closed can-gripping position, and which is operated within the turret by a cam follower 368* which is biased radially inwards into contact with a static cam 370* of cyclically varying radius. That cam and follower arrangement is arranged so as (a) to present the gripper in its open, can-receiving condition to the can then moving into the outfeed station, (b) then as the turret rotates to move the gripper through that station, to allow the movable jaw member to close lightly and temporarily on to the can so as to grip it during the following period whilst it is being rotated to the mouth-down position, and finally (c) to return the jaw member to its open position as the gripper approaches the outfeed conveyor, so as to release the gripped can on to that conveyor. The gripper jaw member remains open until after the gripper has been carried round into engagement with the next can to be gripped and conveyed by that gripper.

In more detail, the outfeed turret 352 includes, beneath a protective cap 600*, a drum 602* which comprises a generally cylindrical outer wall 604* supported by two vertically spaced, integral, transverse walls 606*, 608*. The drum is rotatably carried by complementary taper bearing races 610*, 612* which engage externally with said transverse walls 606, 608, and internally with an upstanding tubular bearing member 614*. That bearing member extends upwardly from the inner wall 616* of an integral annular oil reservoir tank 618*, which tank has an upstanding outer cylindrical wall 620*. That wall has its upper rim extending upwardly into a groove formed in the lower rim of the cylindrical drum wall, in a manner such as to exclude electro-coating fluid from the turret.

An annular turret location plate 622* screwed to the base wall 624* of the reservoir tank 618 has a lower, spigot portion which engages in a turret locating socket 626* which is itself secured on a transverse channel 628*.

An oil pumping sleeve 630* lines the tubular bearing member 614, is supported at its base by a ball bearing race 632* which is trapped in a recess in the oil tank base wall 624 by the turret location plate 622, and is provided in its external cylindrical surface with a spiral oil pumping groove 634*.

A turret driving shaft 636* rises from a torque-limiting device (not shown) which is connected to the gear wheel 332, through a tubular shroud 638*, the support channel 628, the location socket 626, and the oil pumping sleeve 630, and is secured by adjustable coupling means 640* to a transverse circular driving plate 642* which is secured to the upper drum wall 606 by screws 644*. Axially extending teeth 646* formed at the upper end of the oil pumping sleeve 630 engage in driving slots formed internally in the driving plate 642.

Lubricating oil pumped to the top of the pumping sleeve 630 flows downwardly (a) over a baffle plate 648* in which are provided vertical oil holes for directing oil into the upper bearing race 610, and (b) outwardly through transverse radial passages 650* to lubricate the other moving parts that are enclosed within the turret.

The turret has secured around its circumference at each of eight equi-spaced positions a respective can gripper unit 652*, which is removably carried in an aperture 654* formed in the cylindrical wall 604. Each can gripper unit 652 comprises a flanged body 656* secured in said aperture 654, by screws 657*, and having an annular closure member 658* secured thereto, by screws 660*. That closure member secures in position a ball bearing race 662* in which said rotatable shaft 358 is journalled for rotation. That shaft comprises an assembly consisting of (a) a pinion 664* and an integral shaft 666*, (b) surrounding that shaft, an annular support bush 668* which is received in said ball bearing race 662, and (c) a gripper support member 670* which protrudes through said closure member 658, all such parts being secured for rotation together.

Sealing rings 672* are provided on either side of the ball bearing race so as to exclude therefrom lubricating oil from within the turret and electro-coating fluid from outside the turret. The closure member 658 and gripper support bush 668 also carry baffles 674* for minimising the penetration of such fluid.

The flanged body 656 has adjacent the pinion 664 an opening through which the associated vertically reciprocable gear rack 360 extends and meshes with said pinion. That rack has upper and lower support shafts 676*, 678* which are slidably carried via bearing bushes 680*, 682* in the upper and lower transverse walls 606, 608 of the turret drum. The upper support shaft 676 carries around it the said compression spring 361, whilst the lower support shaft carries at its lower end, on a transverse pin 684*, a ball bearing race 686*, of which the outer race member constitutes the said cam follower wheel 362.

An annular cam unit 688* is secured on the base wall 624 of the oil tank 618, and has an upstanding cylindrical wall 690* of varying height, which wall is positioned beneath and supports the said cam follower wheel 362, and so constitutes the said annular cam 364.

The gear rack and associated parts are lubricated by oil dropping from the radial passageways 650.

The rotatable shaft assembly 358 has a central bore in which axially spaced bearing surfaces 692*, 694* formed in the pinion shaft 666 carry a slidable gripper operating shaft 696*. That gripper operating shaft carries (a) at its inner end, said cam follower 368 which is constituted by a ball bearing 698* rotatably held in a bearing socket 700*, (b) at its outer end, a gripper operating button 702* which protrudes beyond the extremity of the gripper support member 670, and (c) intermediate its ends, a compression spring 704* trapped between opposed shoulders formed on the shaft 696 and in the bore of the pinion shaft 666, for biasing the gripper operating shaft radially inwards of the turret.

The cam follower ball 698 rests in contact with the outer surface of a cam ring 706* which encircles and is secured by screws to the central tubular bearing member 614. That cam ring has varying radial depth, and constitutes the said static cam 370 for operating the associated gripper, via said gripper operating shaft 696.

The construction of one said can gripper 354 is best seen in the FIGS. 6 to 9, where it is shown detached from the turret. The can gripper comprises a gripper block 708* having formed in its rear face a cylindrical mounting socket 710* arranged for engagement on a plug portion 712* formed on said gripper support member 670. The gripper block is arranged to be secured on that support member 670 by three screws 712* which are sunk in respective counter-bored holes formed in the gripper block.

The front face of the gripper block is symmetrically shaped at 714* to suit the cylindrical shape of a said can 128 that is to be transported and emptied by the gripper, and that face is relieved at spaced vertically-extending regions 716*, to leave four circumferentially-spaced can-contacting surfaces 718*.

The gripper block is sandwiched between two jaw plates 720*, 722*, which are spaced apart and from the gripper block by four spacer pins 724*–730*. Countersunk fixing screws 732* received in the respective ends of those spacer pins pass through and so clamp the jaw plates to the spacer pins so as to form a said gripper jaw member 366. The three pins 724 to 728 are similar and constitute simple, butted spacer pins for securing together the gripper plates at the desired spacing. The pins 724 and 726 pass with substantial clearance through holes 734* formed in the gripper block. The pin 730 has (a) end portions of reduced diameter which engage in recesses formed in the jaw plates and carry spacer rings 736*, and (b) a central bearing portion 738* which is journalled in a bearing hole 740* formed in the gripper block. Hence, the jaw member 366 is pivotally mounted on the gripper block by means of the spacer pin 730.

Sealing rings 742* encircle the spacer rings 736 and serve to exclude electro-coating fluid from the cooperating bearing surfaces of the gripper block and jaw member.

The gripper block is provided with a first screwed bore 744* which intersects with the clearance hole 734 that houses the spacer pin 724. A bias compression spring 746* is trapped in that bore and is urged into contact with that spacer pin 724 by a grub screw 748*. The gripper block is also provided with a second screwed bore 750* aligned with said first screwed bore 744 and in which is screwed an adjustment stud 752* for setting a biased, 'closed' position of the jaw member 366 relative to the gripper block 708.

The gripper block is also provided with a bore 754*, and a counter-bore 756*, having an axis which intersects with that of the clearance hole 734 housing the spacer pin 726. That counter-bore constitutes the aforesaid socket 710 for receiving the plug portion 712 of the rotatable gripper support member 670.

When a gripper assembly 354 is mounted and secured on a gripper support member 670, the gripper operating button 702 rests adjacent but not touching the jaw operating spacer pin 726, so that the jaw member is biased to the closed position dictated by the setting of the adjustment stud 752. On rotation of the gripper turret, the static cam ring 706 cyclically and temporarily presses the cam follower 698, 700 and gripper operating shaft 696 radially outwards against the thrust of the biasing spring 704, thus causing the jaw operating button 702 to press against and temporarily displace the spacer pin 726 and so temporarily open the gripper jaw member relative to the gripper block.

The jaw plates 720, 722 are shaped in the manner shown, and have each a can-gripping land 758* spaced from a can-ejecting land 760* by a relieved region 762*. Those can-contacting lands are positioned in relation to the can-contacting lands 718 of the gripper block such that when the jaw member is in the closed position gripping a can, that can is contacted by those lands over a circumferential length which exceeds by a small amount half the circumference of the can.

The entrance to the space enclosed by the gripper block 708 and jaw member 366 is inclined relative to the axis of rotation of the gripper at an angle of approximately 25°, which angle is dependent on the relative diameters of the two circular paths followed by a can when travelling respectively (a) on a cell lid 100, and (b) in the grip of a gripper, and is determined to suit the path relative to a gripper of a can entering the gripper at the outfeed station.

For a can of a given diameter, that entrance to the space enclosed by the gripper, when the jaw member 366 is in the open position, has a dimension approximately 1 mm greater than the can diameter. A movement of approximately 1 mm of the can-contacting land 758 of the jaw member 366 between the open and closed positions suffices to enable satisfactory gripping and releasing of those cans.

That small movement of the jaw member is possible since the locus (path) of the can relative to the gripper when travelling from a cell lid into the open gripper is substantially the same as that when travelling from the gripper on to the outfeed conveyor 356, the gripper having inverted itself and the turret rotation having reversed the direction of travel of the can between the moments of gripping the can and subsequently releasing it.

The closed position of the jaw member is adjusted so that the pinch exerted on the electro-coated cans is minimal, and such that no damage is done to the coating newly applied to those cans when the cans are contacted by the said can-contacting lands of the gripper block and jaw member.

On actuation of the gripper operating shaft 696 at a time for opening the gripper, the consequent opening movement of the gripper jaw member 366 relative to the gripper block 708 results in the application of a can-ejecting pressure on the can by the can-ejecting lands 760, so that the can is then moved positively out of contact with the can-contacting lands 718 and falls freely on to the outfeed conveyor. This ensures a prompt release of the can at the time for depositing the can on to that conveyor.

We claim:

1. Transfer apparatus for removing a container, or other article, from a rotating turret, which apparatus comprises:

(a) a transfer wheel mounted for rotation adjacent the turret on a stationary support;

(b) a driving shaft rotatably carried in said support and drivingly connected to said transfer wheel;

a plurality of container holding means mounted at circumferentially spaced positions around said transfer wheel, each said container holding means comprising (i) a radial shaft rotatably mounted in said transfer wheel for rotation about its longitudinal axis and incorporating a gear pinion;

(ii) a jaw assembly carried at the outer end of said radial shaft and comprising opposed jaw members mounted on said radial shaft for relative movement between gripping and relaxed positions thereby to grip and release a said container, and jaw actuating means extending co-axially through said radial shaft and carrying a first spring biased cam follower, for effecting said relative movement of said jaw members;

(iii) a gear rack slidably mounted in said transfer wheel for movement normal to said radial shaft and carrying a second spring biased cam follower, said gear rack engaging said gear pinion for effecting rotation of said radial shaft;

(d) a first cam mounted to said stationary support and engaging said first cam follower, said first cam being shaped to effect operation of said jaw members in a predetermined manner during rotation of said transfer wheel relative to said stationary support; and (e) a second cam mounted to said stationary support and engaging said second cam follower, said second cam being shaped to effect rotation of said radial shaft through 180°, thereby to rotate said jaw members from a container pick-up condition to a container release condition and back again during rotation of said transfer wheel relative to said stationary support;

wherein:

said transfer wheel comprises a hollow drum member comprising spaced upper and lower transverse walls and a peripheral side wall connecting them;

said radial shafts are rotatably carried in said side wall with said gear pinions disposed within said drum member;

said gear racks are disposed within said drum member, and are slidably carried in said upper and lower transverse walls;

said gear racks penetrate said upper transverse wall;

a fluid-tight protective cover is provided on said upper transverse wall to prevent ingress within said drum member of fluid from outside, and said driving shaft extends upwardly through said lower and upper transverse walls and is drivingly connected to said upper transverse wall.

2. Transfer apparatus according to claim 1, wherein said stationary support includes a stationary sleeve through which said driving shaft extends, and said upper and lower transverse walls are rotatably carried on said sleeve.

3. Transfer apparatus according to claim 2, wherein said stationary support includes a base wall from which said stationary sleeve extends, and said base wall has a peripheral cylindrical side wall which cooperates in a fluid-tight manner with peripheral parts of said lower transverse wall to prevent ingress of fluid from outside.

4. Transfer apparatus according to claim 3, wherein said first cam is carried on said stationary sleeve.

5. Transfer apparatus according to claim 3, wherein said second cam is carried on said base wall.

6. Transfer apparatus according to claim 3, wherein said stationary sleeve connects with said base wall to define an annular oil reservoir.

7. Transfer apparatus according to claim 6, wherein an oil pumping sleeve encircles said driving shaft, is drivingly connected thereto, contacts said stationary sleeve internally, and has an oil pumping spriral groove facing the adjacent surface of said stationary sleeve.

8. Transfer apparatus according to claim 1, wherein each said radial shaft is carried in a bearing assembly which is removably secured in said side wall of said drum member, thereby to allow the withdrawal radially of the radial shaft and parts secured thereto.

9. Transfer apparatus for removing a container, or other article, from a rotating turret, which apparatus comprises:

(a) a transfer wheel mounted for rotation adjacent the turret on a stationary support;

(b) a driving shaft rotatably carried in said support and drivingly connected to said transfer wheel;

(c) a plurality of container holding means mounted at circumferentially spaced positions around said transfer wheel, each said container holding means comprising (i) a radial shaft rotatably mounted in said transfer wheel for rotation about its longitudinal axis and incorporating a gear pinion;

(ii) a jaw assembly carried at the outer end of said radial shaft and comprising opposed jaw members mounted on said radial shaft for relative movement between gripping and relaxed positions thereby to grip and release a said container, and jaw actuating means extending co-axially through said radial shaft and carrying a first spring biased cam follower, for effecting said relative movement of said jaw members;

(iii) a gear rack slidably mounted in said transfer wheel for movement normal to said radial shaft and carrying a second spring biased cam follower, said gear rack engaging said gear pinion for effecting rotation of said radial shaft;

(d) a first cam mounted to said stationary support and engaging said first cam follower, said first cam being shaped to effect operation of said jaw members in a predetermined manner during rotation of said transfer wheel relative to said stationary support; and (e) a second cam mounted to said stationary support and engaging said second cam follower, said second cam being shaped to effect rotation of said radial shaft through 180°, thereby to rotate said jaw members from a container pick-up condition to a container release condition and back again during rotation of said transfer wheel relative to said stationary support;

wherein:

said transfer wheel comprises a hollow drum member comprising spaced upper and lower transverse walls and a peripheral side wall connecting them;

said radial shafts are rotatably carried in said side wall with said gear pinions disposed within said drum member;

said gear racks are disposed within said drum member, and are slidably carried in said upper and lower transverse walls; and each said jaw assembly comprises a first arcuate jaw member mounted on the associated radial shaft for rotation therewith, a second arcuate jaw member having a pivotal connection on said first jaw member, and said jaw actuating means includes a jaw actuating shaft coupled to said second jaw member and movable axially through said radial shaft thereby to move said second jaw member between said gripping and relaxed positions.

10. Transfer apparatus according to claim 9, wherein each said second jaw member when in its relaxed position defines together with said first jaw member an entrance for entry of a said container between said jaw members, which entrance is inclined at a predetermined acute angle relative to the axis of rotation of said radial shaft and associated first jaw member so as to facilitate engagement of said jaw members, when in the relaxed condition, around a container approaching on said turret.

11. Transfer apparatus according to claim 10, wherein the path of a said container relative to said relaxed jaw members when moving into said entrance between them at an outfeed station of said turret is substantially the same as that of said container relative to said relaxed jaw members when leaving said entrance and being carried away from them by an associated outfeed conveyor.

12. Transfer apparatus according to claim 9, wherein said first jaw member forms a cradle for receiving a said container, and said second jaw member is arranged for engaging said container at a position disposed remotely from said cradle and such that the container is gripped by said jaw members over a predetermined arc of its circumference, which arc exceeds one half of the container circumference by a predetermined small amount sufficient to ensure control of a gripped container.

13. Transfer apparatus according to claim 12, wherein the pivotal connection of said second jaw member on said first jaw member, and a part of said second jaw member which engages said container both lie on the same side of said first jaw member relative to the axis of rotation of said first jaw member.

14. Transfer apparatus according to claim 13, wherein said second jaw member includes a container-ejecting portion disposed on the side of said pivotal connection remote from said container-engaging part, which portion on relaxing the jaw members moves against a container thereby to urge it away from and so assist its exit from the gripped position between said jaw members.

* * * * *